US008240959B1

(12) United States Patent
Rhoades et al.

(10) Patent No.: US 8,240,959 B1
(45) Date of Patent: Aug. 14, 2012

(54) GEOSYNTHETIC TUFTED DRAIN BARRIER

(75) Inventors: Charles Rhoades, Binghamton, NY (US); Peter J. Ianniello, Havre de Grace, MD (US)

(73) Assignee: Turf Services, Inc., Johnson City, NY (US)

( * ) Notice: Subject to any disclaimer, the term of this patent is extended or adjusted under 35 U.S.C. 154(b) by 215 days.

(21) Appl. No.: 12/780,048

(22) Filed: May 14, 2010

(51) Int. Cl.
*E02D 17/20* (2006.01)

(52) U.S. Cl. ..... 405/302.6; 405/129.95; 428/17

(58) Field of Classification Search .... 405/302.4–302.7, 405/129.75, 129.85, 129.95; 210/503, 504, 210/505, 170.03; 428/85, 95, 87, 17
See application file for complete search history.

(56) References Cited

U.S. PATENT DOCUMENTS

| | | | | |
|---|---|---|---|---|
| 5,436,050 | A * | 7/1995 | Carriker et al. | 428/87 |
| 6,338,885 | B1 * | 1/2002 | Prevost | 428/17 |
| 6,877,932 | B2 * | 4/2005 | Prevost | 405/38 |
| 6,946,181 | B2 | 9/2005 | Prevost | |
| 7,128,497 | B2 | 10/2006 | Daluise | |
| 7,166,340 | B1 * | 1/2007 | Clark | 428/17 |
| 7,682,105 | B2 | 3/2010 | Ayers et al. | |
| 2004/0086664 | A1 * | 5/2004 | Seaton | 428/17 |
| 2005/0129906 | A1 * | 6/2005 | Knox | 428/95 |
| 2008/0020174 | A1 * | 1/2008 | Stull et al. | 428/95 |
| 2008/0216437 | A1 | 9/2008 | Prevost et al. | |
| 2008/0219770 | A1 | 9/2008 | Prevost et al. | |
| 2009/0094918 | A1 | 4/2009 | Murphy et al. | |

* cited by examiner

*Primary Examiner* — Frederick L Lagman
*Assistant Examiner* — Kyle Armstrong
(74) *Attorney, Agent, or Firm* — Mark Levy; Hinman, Howard & Kattell, LLP

(57) ABSTRACT

A geosynthetic tufted drain barrier (GTDB) for preventing vertical migration of fluids. On a substantially impermeable woven or non-woven continuous layer is disposed a membrane. The tensile strength of the impermeable layer is at least 5 lbs/lineal ft (3.0 kg/lineal m). The permeability of the membrane is no greater than $10^{-4}$ cm/sec. Tufted tensile elements are attached to the membrane, each one being attached to the membrane at a density of at least 25 tufted tensile elements per square foot (30 square cm). The tufted tensile elements are formed in rows and are disposed at a density of at least four rows per square foot (30 square cm). Infill material can be introduced to the tufted tensile elements. The drain barrier may be constructed with integrated letters, logos, and signage and one or more colors.

21 Claims, 6 Drawing Sheets

GEOSYNTHETIC TUFTED DRAIN BARRIER

FIELD OF THE INVENTION

The present invention relates to geosynthetic tufted drain barriers (GTDBs) and, more particularly, to a GTDB having a filler material constrained by tufted tensile elements having particular height to prevent infill loss and in which the GTDB can drain surface fluids while resisting erosive forces.

BACKGROUND OF THE INVENTION

Synthetic turf systems, as alternatives to natural grass surfaces, are well known. They represent an improvement over natural grass in some respects, resisting wear and severe weather and typically requiring less maintenance. Prior art synthetic turf systems, sold under trademarks such as Field Turf, Sprint Turf, and Sportex, include a synthetic playing surface often coupled with infill materials.

Artificial grass is used as a covering for everything from landfills to playing fields to airport runways to landscaping to property subject to mudslides and landslides. Geosynthetically-lined slopes are also common. The liners are utilized as barriers and are produced from HDPE, PE, PP, PVC, and other polymers. For safety, improved performance and durability, and longevity, a number of limitations are placed upon the proper design of geosynthetically-lined structures. This is especially true when the liner is exposed to UV light or when natural vegetated cover materials are placed upon the liners.

The concept of using fibers as reinforcement likewise is not new. Fibers such as straw, hemp, asbestos, and synthetic fibers have been used as reinforcement, some since ancient times. In general, soils and concrete are considered to have low tensile characteristics. The addition of synthetic fibers in soils and concrete improves tensile characteristics of the soil or concrete, creating a composite system that benefits from the tensile elements of the fibers.

Geosynthetically-lined slopes have low friction with overlying materials. As a result, cover soils are subject to forces that destabilize the system. In fact, erosion is usually a major source of damage to man-made, as well as natural slopes. Erosion occurs by detachment and movement of soil particles due to impingement thereof by rain and/or surface runoff. When storms, high winds, or precipitation occur, seepage forces are introduced into the cover soils overlying the geomembranes; slope failures can occur. Loss of soil is calculated as a function of regional rainfall, a soil erodibility factor, length of the slope, angle of the slope, and cover management.

Such problems can be overcome by utilizing textured membranes and drainage geocomposites. The textured geomembranes increase the frictional characteristics between the interface between the geomembrane and drainage geocomposite. Drainage geocomposites synthetically replace natural drainage materials such as sand or stone. Drainage geocomposites evolved as a result of the limitations of natural drainage layers when placed above geosynthetically-lined slopes. These limitations included the ability to construct slopes at steep inclination angles.

Drainage geocomposites also have numerous limitations. For example, while drainage geocomposites may provide great speed at conveying fluids, they conversely lack any meaningful storage capacity as a result of their nominal thickness, typically less than 0.50 inches (1.27 cm). If a drainage geocomposite clogs or is improperly sized, the overlying soil becomes saturated. Saturated soils lose internal shear strength and cohesion and are subjected to seepage-induced forces resulting in massive slope failures. Drainage geocomposites are also susceptible to biological clogging. In fact, there are occasions when vegetative soil cover roots entirely clog geosynthetic drainage systems. Moreover, drainage geocomposites are susceptible to exposure to UV light. In fact, engineers often specify that the drainage geocomposite must be covered within 15 days or removed. As a result, requirements are imposed upon the speed at which a drainage geocomposite sloped structure may be installed. Litigation between contractors, engineers, subcontractors, and material suppliers has occurred based upon the construction sequence when utilizing drainage geocomposites.

Granular drainage layers are produced from uniform gradations of sand, stone, or even recycled materials, which may include boiler slag, glass, asphalt, or concrete. Quarries produce uniform gradations through myriad screening processes that sift out larger and smaller materials based upon the "diameter" (distance between extremities) of the materials. Since natural materials are granular, they are often more spherical than cubical. A quarry may actually even tumble natural material to decrease angularity and increase spherical properties. As a result, natural materials for drainage applications are specified based upon diameter and uniformity.

Spheres are circular and tough at tangential points. As a result, sand, stone, or recycled materials produced for uniform diameter achieve a degree of porosity when accumulated. The porosity is achieved because sand, stone, and these recycled materials resist compressive forces. By resisting compression the diameter is maintained and void areas are created. The porosity of the resulting void areas is highly desirable because it allows for the conveyance of fluid and gas.

Uniformly graded sand, stone, and recycled materials lack cohesion. The more cohesive a material, the less permeable the material. A lack of cohesiveness places significant limits on the slope inclination angle for natural or recycled drainage systems.

Despite the limitations of natural or recycled systems, they have significant benefits over synthetic systems in many instances. For example, natural or recycled systems are not subject to UV degradation. Additionally, natural or recycled systems require no protection, as they are not susceptible to puncturing. Often, natural or recycled materials may cost less expensive than do synthetic products.

U.S. Pat. No. 6,946,181, issued to Prevost for ARTIFICIAL GRASS FOR LANDSCAPING, discloses an artificial grass surface suitable for flat surfaces, such as bordering a runway of an airfield in order to reduce the presence of birds in the airfield. The artificial grass surface includes a pile fabric having a plurality of pile elements extending from a substantially impermeable layer mat and resembling grass. A water barrier is provided for preventing water from percolating to the compacted soil surface. Infilled particulate material is dispersed among the pile elements. A stabilizer is provided to resist dislodgment of the infilled particulate material at the edges of the runways by the thrust of jet engines and to keep the particulate material in the pile elements when the edges of the runways are vacuumed to remove silt.

U.S. Published Patent Application No. 2009/0094918 for TILE FOR SYNTHETIC GRASS SYSTEM on application by Stephen Murphy, et al. discloses a tile intended to be laid in the center of an area upon which the synthetic grass assembly will be installed.

U.S. Published Patent Application No. 2008/0216437 for TILE FOR A SYNTHETIC GRASS SYSTEM on application by Prevost, et al. also discloses a tile for a synthetic grass system. The tile has a top surface with a plurality of trusses and a bottom surface with a plurality of legs extending therefrom. The trusses intersect and form apertures. The top surface has a plurality of sections hingedly attached to adjacent sections with expansion members.

U.S. Published Patent Application No. 2008/0219770 for DRAINAGE SYSTEM FOR SYNTHETIC GRASS SYSTEM, METHOD OF INSTALLING A SYNTHETIC GRASS SYSTEM AND BUSINESS METHOD OF PROVIDING A SYNTHETIC GRASS SYSTEM on application by Prevost, et al. discloses a drainage system having a base having a center portion with a first depth and a perimeter channel with a second depth being greater than the first depth, a plurality of tiles above the base, and a synthetic grass above the plurality of tiles.

U.S. Pat. No. 7,128,497, issued to Daluise for HORIZONTALLY DRAINING ARTIFICAL TURF SYSTEM, discloses a horizontally draining artificial turf system comprising an impervious base at proper slope, an impermeable layer or drainage blanket over the base at a corresponding slope for guiding water horizontally, an artificial turf at top of the impermeable layer, and a perforated pipe near the lower edge of the base for receiving water for evacuation. Rainwater over the artificial turf first drains vertically onto the impermeable layer and then flows along the impermeable layer to reach the perforated pipe, without infiltrating into the base. Alternatively, a partially pervious drainage blanket is provided in lieu of the impermeable layer where the base is partially pervious. Backup rainwater runs off the drainage blanket horizontally after it saturates the soils of the base.

U.S. Pat. No. 7,682,105 issued to Ayers et al. for COVER SYSTEM FOR WASTE SITES AND ENVIRONMENTAL CLOSURES discloses a cover system comprising a synthetic grass and an impermeable geomembrane that can be applied without the use of heavy earthwork equipment as temporary or final cover to control odors, erosion, gas migration and contaminate migration. The cover system does not require the use of an extensive anchoring system to resist wind uplift or slope failure.

It is therefore an object of the present invention to provide a geosynthetic tufted drain barrier with low vertical permeability and high plane permeability or transmissivity, and to provide in-plane flow of liquid while constraining infill material.

It is also an object of the invention to provide means and methods for combining two or three layers of thermoplastic into such GTDB.

It is a further object of the invention to create a geosynthetic tufted drainage barrier structure that possesses low vertical permeability, but high plane permeability or transmissivity.

It is also an object of the invention to provide a GTDB that is laminated to a gas transmissive element, integrating an upper surface of synthetic turf to high transmissive geonet cores to permit the timely egress of undesirable fluids or gases.

SUMMARY OF THE INVENTION

The present invention is a geosynthetic tufted drain barrier (GTDB) for preventing vertical migration of fluids. On a substantially impermeable layer is disposed a membrane. The substantially impermeable layer can be woven or non-woven. The tensile strength of the substantially impermeable layer is at least 25 lbs/lineal ft (14.8 kg/lineal m). The permeability of the membrane is no greater than $10^{-4}$ cm/sec. A plurality of tufted tensile elements is integral with the membrane. The plurality of tufted tensile elements has a density of at least 25 tufted tensile elements per square foot (30 square cm) of the membrane. The tufted tensile elements are disposed on the membrane in rows and are disposed at a density of at least four rows per square foot (30 square cm).

Therefore, the upper surface of the tufted tensile elements is uniformly placed to achieve a uniform distribution of tensile elements within an overlying soil structure to increase stability of a natural cover system above a geosynthetically-lined slope. By choosing one or more layers of the drain barrier, tufted tensile element heights, and row spacings, various uniform gradations of granular fill (infill material) may be utilized on steep-lined slopes to maintain stability. The infill material can be any one of the group: sand, stone, rubber, boiler slag, recycled concrete, asphalt, recycled glass, and expansive minerals, or combinations thereof. The tufted tensile elements may be produced in colors to reflect the color of natural grass or the surrounding environment.

BRIEF DESCRIPTION OF THE DRAWINGS

A complete understanding of the present invention may be obtained by reference to the accompanying drawings when taken in conjunction with the detailed description thereof and in which.

DETAILED DESCRIPTION OF THE PREFERRED EMBODIMENT

The present invention is a geosynthetic tufted drain barrier for preventing vertical migration of fluids. On a membrane is disposed a substantially impermeable layer or anchor backing. The substantially impermeable layer can be woven or non-woven. A plurality of tufted tensile elements is attached and forms a part of the substantially impermeable layer in aligned or offset rows. Infill material chosen from the group: sand, stone, rubber, slag, recycled concrete, recycled glass, and expansive minerals, or combinations thereof can be introduced to the tufted tensile elements. The structure consists of combining a liner, vertical or tufted tensile elements, and a natural or recycled uniformly graded, granular-based drainage system to allow for surface water collection and removal while maintaining slope stability of the drainage layer.

Figure 1:
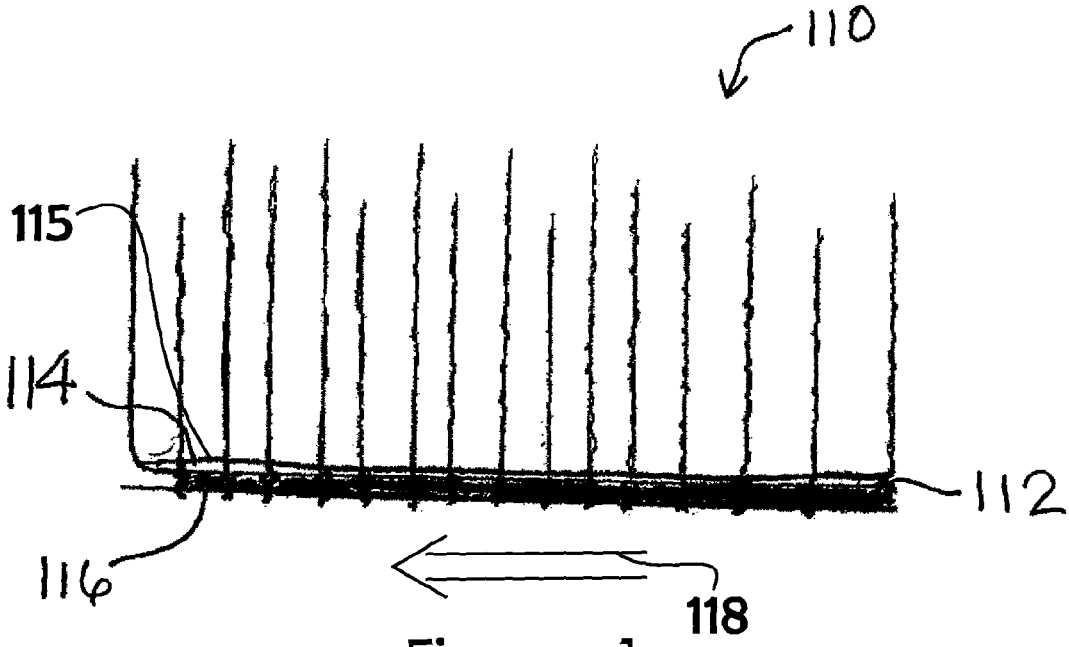
FIG. 1 is a cross sectional view of a geosynthetic tufted drain barrier in accordance with a preferred embodiment of the present invention.
Figure 5A:
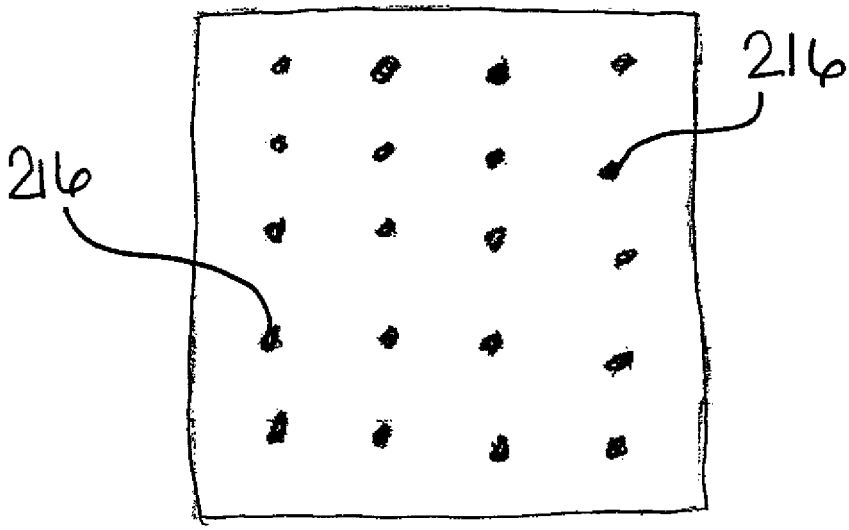
FIGS. 5*a* and 5*b* are enlarged top views of the pattern of tensile elements shown in an aligned and an offset orientation, respectively.
Figure 5B:
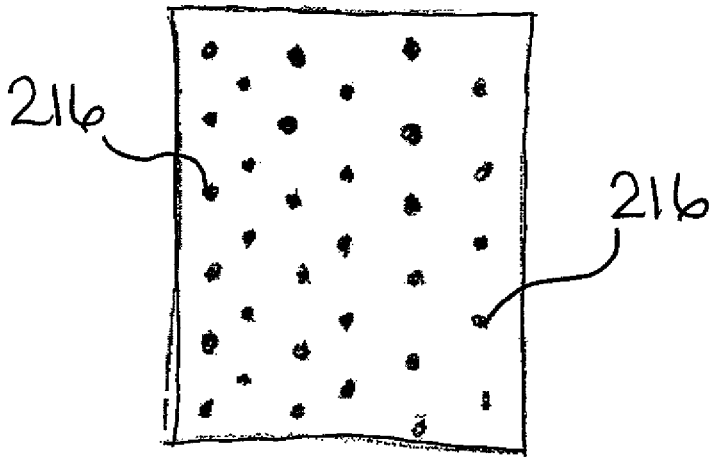

Referring now to FIG. 1, there is shown a GTDB 110 of the invention. Liner 112 consists of a substantially impermeable layer 114 having upper surface 115 and a membrane 116, described in greater detail hereinbelow. The substantially impermeable layer 114 is designed so that pullout of a tensile structure 216 is prevented and the primary barrier 112 remains impermeable. In FIG. 1, machine direction is into the page, and cross machine direction is shown as direction arrow 118. That is, when tensile structures 216 are applied to substantially impermeable layer 114, the machine processes the rows of fibers as seen in FIGS. 5*a* and 5*b*. A tensile element pullout force of at least 1 lb (0.5 kg) is preferred. Tensile elements 216 are either hydroscopic or hydrophobic.

Figure 2:
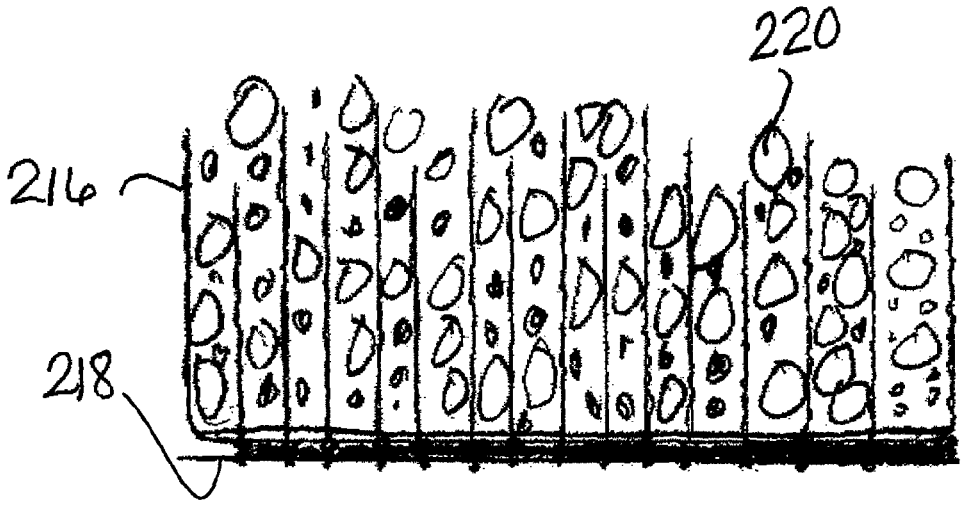
FIG. 2 is a cross sectional view of the preferred embodiment of FIG. 1 showing infill between the vertical tensile elements.

Referring now to FIG. 2, there is shown a cross sectional view of the GTDB 110 with vertical tensile elements 216, created from substantially impermeable layer 114 of liner 112 and extending vertically therefrom in spaced apart configuration. In other words, tensile elements 216 and substantially impermeable layer 114 form a unitary structure. These tensile elements 216 are tufted 218 at the lower extremities thereof. The height of tensile elements 216 can be calculated based on the slope of the area to be covered (not shown), the degree of required erosion control, and the amount of infill to be added. Prevention of soil loss is critical on earthen structures. The inventive GTDB 110 incorporates techniques to minimize the erosive forces and also utilizes permeability and slope length to contain drainage within the thickness thereof. In fact, the GTDB for preventing vertical migration of fluids resists loss of infill to achieve no more than 750 tons/per/acre/year of infill from erosive forces.

Row spacing of tensile elements 216, described in greater detail hereinbelow, can maximize the frictional characteristics between granular material used as infill 220 and the vertical or tufted tensile elements 216. For example, a smaller diameter granular material 220 may achieve maximum contact and friction with the barrier 110 when the row spacing of tensile elements 216 is only ¼ inch (0.6 cm), while a larger gradation of fill 220 such as a NYSDOT Class 1A may benefit from a row spacing of tensile elements 216 of ¾ inch (1.9 cm).

Figure 3:
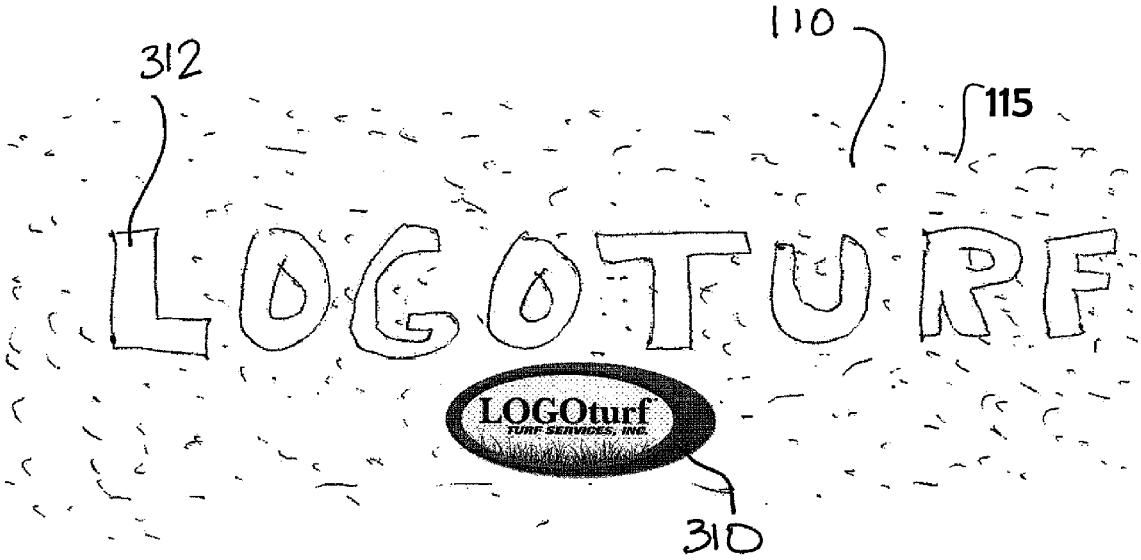
FIG. 3 is a plan view of the preferred embodiment with an upper surface and words and logo disposed thereon.

Referring now to FIG. 3, there is shown a logo 310 and words 312 associated therewith disposed on the upper surface 115 of substantially impermeable layer 114 of GTDB 110. The use of logos on horizontal surfaces is well known in stadium design. Logos and signage are herein combined within the inventive structures.

Figure 4:
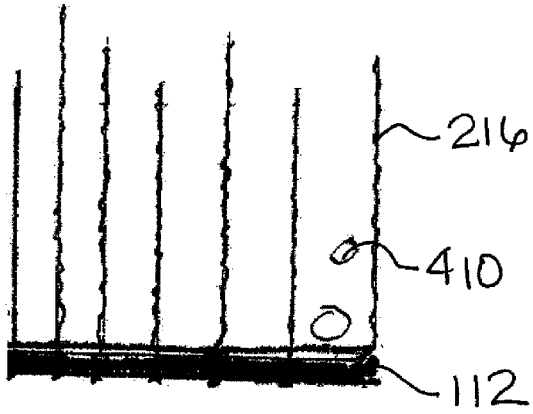
FIG. 4 is an enlarged cross sectional side view of the barrier of FIG. 1 showing uniformly graded, granular-based infill materials between the vertical tensile elements.

Referring now to FIG. 4, uniformly graded, granular-based material 410 is shown as infill material 220 disposed between tensile elements 216. The material 410 may be sand, stone, gravel, rubber, slag, recycled concrete, recycled rubber tires, recycled glass, and expansive minerals, such as bentonite. This material 410 is used on geosynthetically-lined slopes (not shown) by incorporating uniform vertical tensile elements 216 within the overlying natural material and then transferring those stresses to the geosynthetic tufted drainage barrier system 110. The GTDB 110 is designed with sufficient tensile strength to resist elongation. Load and stresses are transferred through the GTDB 110 structure to the top of the slope(s). The GTDB 110 is highly resistant to UV degradation so there is overlapping within the construction sequence between geosynthetic installation and natural cover soil placement. The distance between earth contractors and specialty geosynthetic contractors is increased in terms of time and space so that the likelihood of conflict is also minimized.

Referring now to FIG. 5*a*, there is shown a plan view of the vertical tensile elements 216 in aligned configuration with respect to one another. Alternatively, FIG. 5*b* shows the tensile elements 216 in an offset configuration with respect to one another. Of course, the invention includes any pattern of placement of tensile elements 216, and is not limited to those patterns shown in FIGS. 5*a* and 5*b*.

Figure 6:
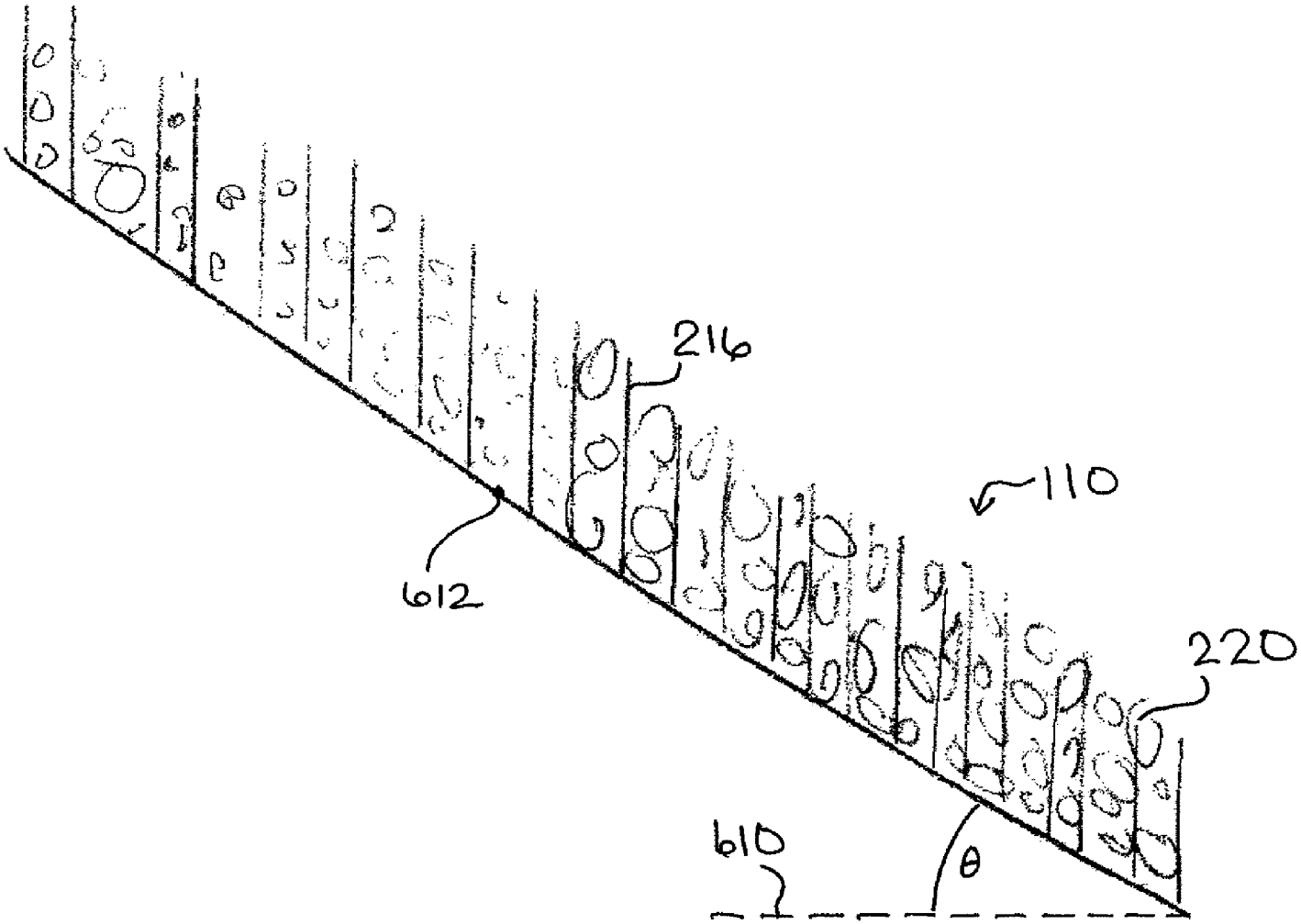
FIG. 6 is a geosynthetic tufted drain barrier shown in situ on a slope.

Referring now to FIG. 6, the GTDB 110, shown with infill 220 between vertical tensile elements 216, is positioned at an angle, θ, with respect to level ground 610, simulating a slope of materials to be covered having an angle θ. A seam 612 connects the upper and lower portion of GTDB 110, as shown. A more detailed description of seams 612 appears hereinbelow.

Figure 7:
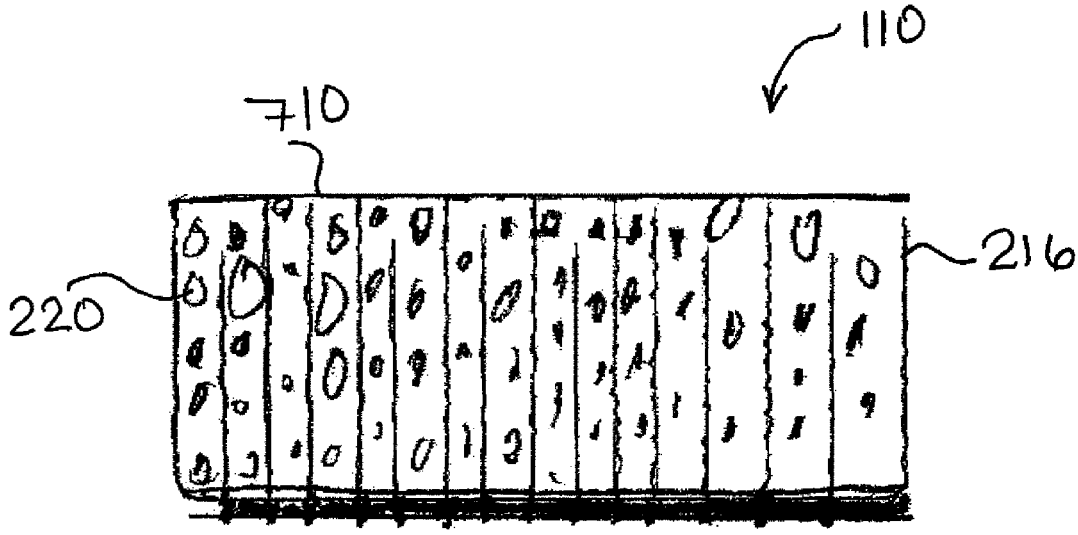
FIG. 7 is a cross sectional view of the GTDB of FIG. 1 having a tensile mesh on the upper most portion thereof.

Referring now to FIG. 7, there is shown the GTDB 110 with a covering 710 above the uppermost portions of tensile elements 216 and contained infill 220. Covering 710 may be woven or non-woven geotextile at its upper surface and may consist of gabion mesh, reno mattress mesh, metal fence, plastic grid, or other tensile mattress. The function of covering 710 is to retain infill 220 in the event of erosion-causing activities (e.g., severe weather), such as rainfall and runoff.

Figure 8:
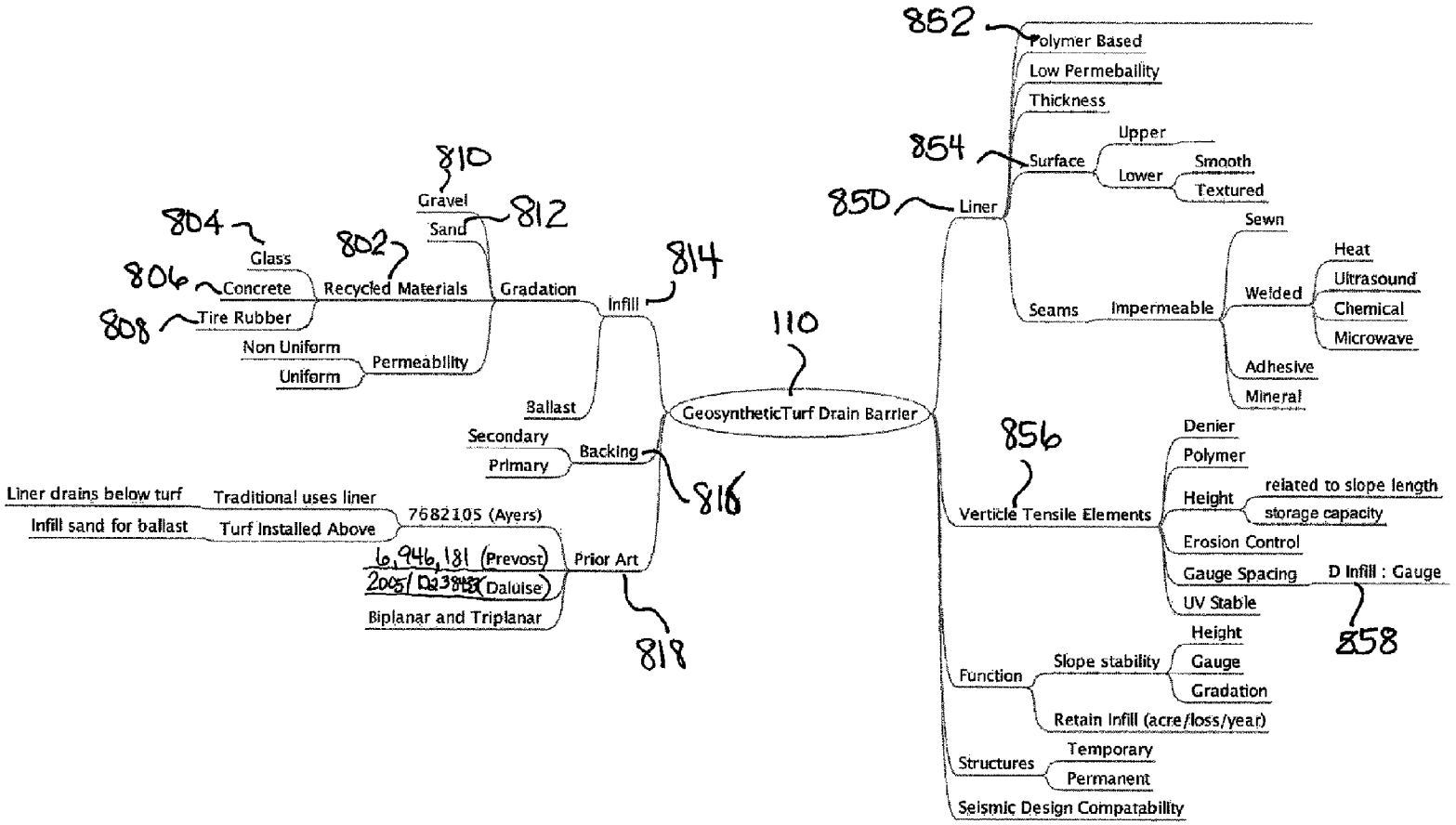
FIG. 8 is a chart of prior art and current technology, some of which is embodied in the present invention.

Referring now to FIG. 8, there is shown a chart of prior art systems on the left and GTDB features on the right. Historically, certain recycled materials 802 have been used to provide gradation of the materials to be covered. Such recycled materials 802 include, but are not limited to, glass 804, concrete 806, and rubber tires 808. Other conventional materials for providing gradation include gravel 810 and sand 812. The materials can be uniform or non-uniform, but generally are permeable. All of these materials are considered infill 814. One or more backings 816 are also provided. Prior art patents 818 describe covers or cover/drainage systems for the facilities hereinabove mentioned.

Liner 850 comprises: a low permeability membrane 852 of PVC, Polyurethane, HDPE, PP, or LLDPE; a backing 854 having a smooth or textured lower surface; and tufted vertical tensile elements 856 disposed substantially perpendicular to the plane of the liner 850. The vertical tufted tensile elements 856 have variable height, related to the slope length and storage capacity, for providing erosion control. Infill 858 is also provided. Membrane 852 is attached to and/or integrated with substantially permeable layer 854 by liquid or spray coating the membrane 852, laminating, using a geosynthetic clay liner (GCL), using a suitable adhesive, or other means for attaching the membrane 852 to layer 854, known in the art.

The inventive geosynthetic tufted drain barrier 110 provides the connection between prior art systems and the novel features of the present system.

Embodiments of the invention can be made in large pieces, for example, several meters wide and many meters long. Rolls (not shown) of the GTDB 110 are preferably 15' (4.5 m) wide×100' (30 m) in length to decrease longitudinal seams although such dimensions are not intended to limit the inventive concept. Rolls of the synthetic turf barrier are preferably delivered and assembled in lengths that span an entire slope to eliminate any attachment, or seaming of materials end to end. Moreover, for convenience in installation, the GTDB 110 may be installed in portions, which are interconnected such that seams 612 (FIG. 6) may be welded, glued, sewn, or taped in order to make them impermeable also. Typically, the drainage barrier 110 is positioned on slopes and the tensile elements 216 are infilled with a granular material 220 of uniform gradation. The gradation allows for sufficient permeability so fluids (not shown) may be conveyed within the plane and thickness of the GTDB structure 110.

The drain barrier 110 can be used as a final cover system for a hazardous waste site, in which case the user may desire to construct the words "DANGER" or "WARNING" thereon. Moreover, the user may wish to utilize the drain barrier on the side of a reservoir, in which case the words, "POTABLE WATER" may be constructed on the GTDB 110. As an additional example, a corporation may wish to construct its name 312 or logo 310 on its GTDB 110 at a theme park, its corporate headquarters, or some other site.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A geosynthetic tufted drain barrier (GTDB) for preventing vertical migration of gases and fluids, constraining soil particles, providing drainage, and retaining granular materials with predefined permeability, comprising:

a) a single, substantially impermeable continuous layer having a plurality of tufted tensile elements integral thereto, at least a portion of said plurality of tufted tensile elements having a predetermined length and gauge spacing co-dependent on the thickness and gradation of filler material, thickness of GTDB, angle and length of slope on which said GTDB is disposed, and amount of liquid in-plane flow;

b) a membrane having at least one of the group of attachment stated: liquid applied onto, laminated, and integrated with, said substantially impermeable continuous layer; and c) filler material proximate said plurality of tufted tensile elements and partially constrained thereby, said filler material for facilitating draining and being selected from the group: sand, stone, gravel, rubber, boiler slag, asphalt, recycled concrete, recycled rubber tires, recycled glass, and expansive minerals.

2. The GTDB for preventing vertical migration of gases and fluids, constraining soil particles, providing drainage, and retaining granular materials with predefined permeability of claim 1, wherein the permeability of said membrane is no greater than $10^{-4}$ cm/sec.

3. The GTDB for preventing vertical migration of gases and fluids, constraining soil particles, providing drainage, and retaining granular materials with predefined permeability of claim 2, wherein said membrane is at least 5 mils (0.13 mm) thick and comprises at least one of the group: polyethylene (PE), polypropylene (PP), polyurethane, PVC, rubber, asphalt, bitumen, synthetic, polymeric and mineral sealant or impermeable barrier.

4. The GTDB for preventing vertical migration of gases and fluids, constraining soil particles, providing drainage, and retaining granular materials with predefined permeability of fluids of claim 2, wherein said membrane has a horizontal permeability of at least $10^{-4}$ cm/sec.

5. The GTDB for preventing vertical migration of gases and fluids, constraining soil particles, providing drainage, and retaining granular materials with predefined permeability of claim 1, wherein said substantially impermeable layer is chosen from the group: woven, non-woven, knitted geogrids, plastic geogrids, piped geosynthetics, and other synthetics.

6. The GTDB for preventing vertical migration of gases and fluids, constraining soil particles, providing drainage, and retaining granular materials with predefined permeability of claim 5, wherein the tensile strength of said substantially impermeable layer is at least 5 lbs/lineal ft (3.0 kg/lineal m) in either the machine or cross machine direction and a tuft bind force of at least approximately 1 lb (0.5 kg).

7. The GTDB for preventing vertical migration of gases and fluids, constraining soil particles, providing drainage, and retaining granular materials with predefined permeability of claim 5, wherein said plurality of tufted tensile elements of said substantially impermeable layer has a density of at least 25 tufted tensile elements per square foot (30 square cm).

8. The GTDB for preventing vertical migration of gases and fluids, constraining soil particles, providing drainage, and retaining granular materials with predefined permeability of claim 7, wherein said tufted tensile elements are formed from said substantially impermeable layer in rows and are disposed at a density of at least four rows per foot (30 cm).

9. The GTDB for preventing vertical migration of gases and fluids, constraining soil particles, providing drainage, and retaining granular materials with predefined permeability of claim 8, wherein said tufted tensile elements are produced in rows of at least one of the group of configurations: parallel to the machine direction of the roll and perpendicular to the machine direction thereof, adjacent rows being at least one of the group: aligned with one another and offset with one another.

10. The GTDB for preventing vertical migration of gases and fluids, constraining soil particles, providing drainage, and retaining granular materials with predefined permeability of claim 9, wherein spacing between said rows of tufted tensile elements is filled with at least one element from the group: sand, stone, recycled concrete, recycled glass, rubber, other natural materials, and other synthetic materials with permeability no less than $10^{-6}$ cm/sec and a thickness of between approximately ⅛" (0.32 cm) and 6" (15 cm).

11. The GTDB for preventing vertical migration of gases and fluids, constraining soil particles, providing drainage, and retaining granular materials with predefined permeability of claim 1, wherein said expansive materials comprise at least one of the group: volclays, kaolinite, bentonite, and bentonite derivatives.

12. The GTDB for preventing vertical migration of gases and fluids, constraining soil particles, providing drainage, and retaining granular materials with predefined permeability of claim 1, further comprising:

d) substantially impermeable seams for connecting adjacent panels of said GTDB to one another to achieve a permeability of no more than $10^{-4}$ cm/sec.

13. The GTDB for preventing vertical migration of gases and fluids, constraining soil particles, providing drainage, and retaining granular materials with predefined permeability of claim 12, wherein said substantially impermeable seams are constructed by at least one of the group: sewing, welding, taping, bonding, and sealing with synthetic or mineral materials to achieve a permeability of no greater than $10^{-4}$ sec.

14. The GTDB for preventing vertical migration of gases and fluids, constraining soil particles, providing drainage, and retaining granular materials with predefined permeability of claim 1, wherein the height of said tufted tensile elements is selected to increase storage capacity of surface liquids and as a function of slope length.

15. The GTDB for preventing vertical migration of gases and fluids, constraining soil particles, providing drainage, and retaining granular materials with predefined permeability of claim 1, wherein the impermeable barrier is proximate a polyethylene (PE), polypropylene (PP), or polymeric core element comprising a geosynthetic element having a plurality of porous media constructed and arranged to form a plurality of interconnected transmission paths.

16. The GTDB for preventing vertical migration of gases and fluids, constraining soil particles, providing drainage, and retaining granular materials with predefined permeability of claim 1, wherein the tufted tensile elements and infill form a composite system and resist loss of infill to achieve no more than 750 tons/per/acre/year of infill from erosive forces.

17. The GTDB for preventing vertical migration of gases and fluids, constraining soil particles, providing drainage, and retaining granular materials with predefined permeability of claim 1, wherein said tufted tensile elements further comprise an upper surface chosen from the group: gabion mesh, reno mattress mesh, metal fence, plastic grid, woven geotextile, non-woven geotextile, and other tensile mattress.

18. The GTDB for preventing vertical migration of gases and fluids, constraining soil particles, providing drainage, and retaining granular materials with predefined permeability of claim 1, wherein said drainage further comprises the minimization of the erosive forces utilizing said impermeable layer, said tensile elements, and said infill to restrain drainage to said upper surface of said substantially impermeable continuous layer.

19. A geosynthetic tufted drain barrier (GTDB) for preventing vertical migration of gases and fluids, constraining soil particles, providing drainage, and retaining granular materials with predefined permeability, comprising:

a) a single, substantially impermeable continuous layer having an upper surface and a lower surface having a plurality of tufted tensile elements integral thereto, at least a portion of said plurality of tufted tensile elements having a predetermined length and gauge spacing dependent on the thickness and gradation of filler material, thickness of GTDB, angle and length of slope on which said GTDB is disposed, and amount of liquid in-plane flow;

b) a logo, letter, or symbol disposed on said upper surface of said substantially impermeable continuous layer; and c) filler material proximate said plurality of tufted tensile elements and partially constrained thereby, said filler material for facilitating draining and being selected from the group: sand, stone, gravel, rubber, boiler slag, asphalt, recycled concrete, recycled rubber tires, recycled glass, and expansive minerals.

20. The GTDB for preventing vertical migration of gases and fluids, constraining soil particles, providing drainage, and retaining granular materials with predefined permeability of claim 19, wherein said logo, letter, or symbols is created by at least one of the group: seaming, welding, sewing, painting, and connecting.

21. The GTDB for preventing vertical migration of gases and fluids, constraining soil particles, providing drainage, and retaining granular materials with predefined permeability of claim 19, wherein said tufted tensile elements further comprise an upper surface chosen from the group: gabion mesh, reno mattress mesh, metal fence, plastic grid, woven geotextile, non-woven geotextile, and other tensile mattress.

* * * * *